US006209141B1

(12) United States Patent
Adeli

(10) Patent No.: US 6,209,141 B1
(45) Date of Patent: Apr. 3, 2001

(54) DECORATIVE BAND FOR SOCK

(76) Inventor: Pamela Adeli, 2319 Fripp Overlook NW., Acworth, GA (US) 30101

( * ) Notice: Subject to any disclaimer, the term of this patent is extended or adjusted under 35 U.S.C. 154(b) by 0 days.

(21) Appl. No.: 09/575,616

(22) Filed: May 22, 2000

Related U.S. Application Data

(60) Provisional application No. 60/162,123, filed on Oct. 29, 1999.

(51) Int. Cl.[7] ..... A41B 11/00

(52) U.S. Cl. ..... 2/239

(58) Field of Search ..... 2/239, 240, 241, 2/242, 244, 60, 61, 62, 59, 409, 22, 912, 919, 920; D5/63; D2/980; 66/171

(56) References Cited

U.S. PATENT DOCUMENTS

| | | | | |
|---|---|---|---|---|
| 197,868 | * | 12/1877 | Langford | 2/61 |
| D. 374,764 | | 10/1996 | Penn . | |
| D. 410,149 | * | 5/1999 | Sweeney | D5/63 |
| 615,271 | * | 12/1898 | Hayden et al. | 2/239 |
| 743,625 | | 11/1903 | Douglas . | |
| 1,708,144 | * | 4/1929 | Martin | 2/61 |
| 1,746,485 | * | 2/1930 | Lynk | 2/61 |
| 2,065,936 | | 12/1936 | Hardie . | |
| 2,228,404 | | 1/1941 | Saftlas et al. . | |
| 2,571,543 | | 10/1951 | Connor . | |
| 2,719,977 | * | 10/1955 | Fields | 2/61 |
| 2,918,679 | | 12/1959 | Bell . | |
| 3,122,906 | | 3/1964 | Crawford . | |
| 3,238,537 | | 3/1966 | Fowler et al. . | |
| 3,501,774 | * | 3/1970 | Norman | 2/240 |
| 4,034,580 | | 7/1977 | Holder . | |
| 5,067,177 | | 11/1991 | Binder . | |
| 5,699,557 | * | 12/1997 | Johnson | 2/239 |
| 5,774,898 | | 7/1998 | Malpee . | |
| 5,823,012 | * | 10/1998 | Hacskaylo | 66/171 |
| 5,867,839 | | 2/1999 | Lawlor . | |
| 5,898,948 | | 5/1999 | Kelly . | |
| 6,105,173 | * | 8/2000 | Brown | 2/239 |

FOREIGN PATENT DOCUMENTS

| | | |
|---|---|---|
| 835354 | 12/1938 | (FR) . |
| 982991 | 6/1951 | (FR) . |
| 2457645 | 12/1980 | (FR) . |

* cited by examiner

*Primary Examiner*—Amy B. Vanatta
(74) *Attorney, Agent, or Firm*—Richard C. Litman

(57) ABSTRACT

A pair of sock bands or covers to be used in conjunction with an ordinary pair of socks which are tubular-shaped and made of a woven elastic material which can be slid onto the top of a sock. The sock bands may include a fastener which is disposed around the inner surface of the sock band. The outer surface of each sock bands may contain indicia such as a logo or name of a team or organization.

4 Claims, 2 Drawing Sheets

DECORATIVE BAND FOR SOCK

CROSS-REFERENCE TO RELATED APPLICATION

This application claims the benefit of U.S. Provisional Patent Application Ser. No. 60/162,123, filed Oct. 29, 1999.

BACKGROUND OF THE INVENTION

1. Field of the Invention

The present invention relates to decorative bands for a pair of socks, and more specifically, decorative bands for a pair of socks to identify a sports team, holiday occasion, or organizational logo.

2. Description of Related Art

Ever since the invention of socks, hosiery, and stockings, people have been inventing ideas to keep the top of the socks from sliding down the wearer's leg. Many other types of attachments to socks and hosiery has also been the subject of patentability. The following design patent illustrates a fashionable sock. Des. U.S. Pat. No. 374,764, issued to Deborah M. Penn on Oct. 22, 1996, illustrates a sock dickie. The ornamental design of the sock dickie shows a dickie having a fuzzy upper half.

The following patents describes different types of socks, anklets, and hosiery for various uses from keeping a person's ankle warm to holding up the top of the sock above the wearer's calf. U.S. Pat. No. 743,625, issued to Elizabeth M. Douglas on Nov. 10, 1903, describes an anklet to protect a person's ankle from the cold weather.

U.S. Pat. No. 2,065,936, issued to Harry Hardie on Dec. 29, 1936, describes a band of a sock or stocking for wearing apparel. The band is anchored to the upper portion of the sock and comprises a strip of elastic rubber which presses a roughened surface against the wearer. The rubber strip is sewed in a position in a tubular welt knitted in the upper end of the sock. The band and sock are one unit comprising a body of knitted silk with an upper end with a welt forming a hollow tubular member.

U.S. Pat. No. 2,228,404, issued to Saftlas, et al. on Jan. 14, 1941, describes a supporter for holding up an article of clothing on someone's leg. The invention comprises a stocking which takes the form of a half hose having a welt which is either of the turned type or ribbed top commonly employed in a men's half hose.

U.S. Pat. No. 2,571,543, issued to Walter F. Connor on Dec. 6, 1948, describes a cloth top sock. The foot, ankle, and leg of the sock are constructed of knitted material while the cuff is constructed of woven material. U.S. Pat. No. 2,918,679, issued to Henry G. Bell on Dec. 29, 1959, describes an elastic support for a stocking. The knee-high stocking includes a knitted top or welt, a leg portion, a heel pocket, a foot, and a toe pocket. All the portions are of a unitary structure.

U.S. Pat. No. 3,122,906, issued to Herman E. Crawford on Mar. 3, 1964, describes a self-supporting hosiery top. The self-supporting hosiery top includes inwardly extending loops of relaxed frictional material around the inner periphery at the top. The material frictionally engages the leg of the wearer to support the top of the hose.

U.S. Pat. No. 3,238,537, issued to Fowler, et al. on Mar. 8, 1966, describes an ankle warmer. The main function of the ankle warmer is to be worn around the ankle of the wearer to provide desired warmth for the lower extremities, and at the same time to be fashionable. The ankle warmer comprises an elongated strip of material, convexly contoured in a direction transverse to its axis. The material strip has two free ends which are attached together around an ankle by a fastening means such as clip hooks.

U.S. Pat. No. 4,034,580, issued to Otis W. Holder on Jul. 12, 1977, describes a boot sock with a stay-up cuff and a method. The stay-cuff includes an outwardly turned welt integrally knit to the top of the leg of the sock. The single-ply edge portion is adapted to extend down over the upper edge of the boot to prevent the sock from being drawn into the boot.

U.S. Pat. No. 5,067,177, issued to Margaret L. Binder on Nov. 26, 1991, describes cuff-like tubular extensions for wearing apparel. The cuff-like elements are formed from a textile which causes them to constrict about the wearer's legs or arms. A plurality of cuff-like elements may be interfitted with each other and worn independently of other apparel. The cuff-like elements can be separate from the wearing apparel.

U.S. Pat. No. 5,774,898, issued to Mitchell G. Malpee on Jul. 7, 1998, describes an athletic footwear for beach terrain. The three portions of the footwear include a permeable elastic portion on the top of the foot, an insulative portion on the bottom of the foot and a toe portion. Top portion includes a Spandex or leather band for extra support to hold up the footwear.

U.S. Pat. No. 5,867,839, issued to Michael R. Lawlor on Feb. 9, 1999, describes an athletic sock garter and method of using the same. The garter is an elongated strap comprised of an elastic material. An adjustable fastener is connected to the elongated strap about the leg portion of the sock. U.S. Pat. No. 5,898,948, issued to Graham M. Kelly on May 4, 1999, describes a support sport sock. The sock includes a sock body of an elastomeric material which is supported against the calf of a wearer's leg by the elastic material. The sock includes a padded heel and biomechanical support panels.

France Pat. No. 835,354, published December, 1938, and France Pat. No. 982,991 published June, 1951, both illustrate a band for tucking in the end of the wear's pant leg along the top of a boot. France Pat. No. 2,457,645, published December, 1980, illustrates a band incorporated into the top of a sock and an additional separate band to act as a shield around the ankle and boot of the wearer.

There is a need for a band that slides over the top of any sock to identify a sports team, holiday occasion, or organizational logo. The band should be movably attachable or detachable in order for the band to be transferred from one sock to another. The band could be transferred to a new sock if the wearer outgrows the other socks or gets a hole in the existing socks. The sock bands would be used day after day without having to wash them after each use.

None of the above inventions and patents, taken either singly or in combination, is seen to describe the instant invention as claimed.

SUMMARY OF THE INVENTION

The present invention is sock bands or covers which include a tubular-shaped elastomeric woven fabric which is slidable onto the top of a sock. The sock bands may include a fastening means to be placed around the inner surface of the sock band. The outer surface of the sock bands may contain indicia such as a logo or name of a team or organization.

Accordingly, it is a principal object of the invention to provide a sock band that can bear a logo, name, color, preprinted fabric, and/or design to identify a particular team or organization.

It is another object of the invention to provide a decorative sock band that requires no fastening means in securing the sock band to the top portion of a sock.

It is a further object of the invention to provide sock bands that can transform a regular casual sock into a more decorative and functional look.

Still another object of the invention is to provide sock bands that can be worn many days in a row before being washed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
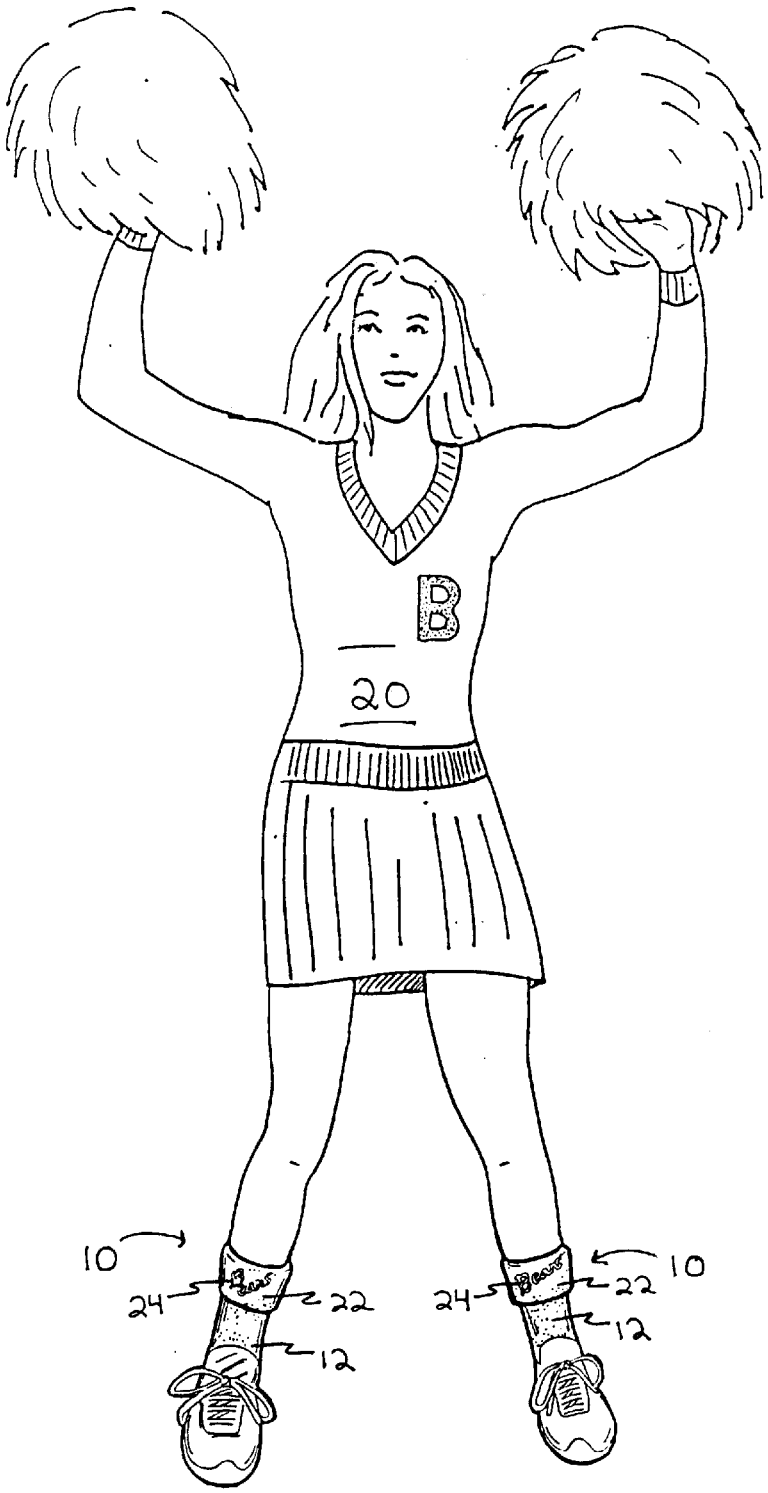
FIG. 1 is an environmental, perspective view of a cheerleader wearing the decorative band over her socks according to the present invention.

The present invention are decorative bands or covers for the top of a pair of socks designated as 10 in the drawings. The sock bands or covers comprise a tubular-shaped woven elastic material or stretch fabric which can be slid onto the top of a sock. The sock band has an inner and outer surface. The sock bands may include a fastening means to be placed around the inner surface of the sock band. Depending on the type of fastening means utilized, a pair of socks may also be included as part of the invention. Each sock includes a top portion and a bottom portion.

FIG. 1 illustrates a cheerleader 20 wearing a pair of sock bands 10 on an ordinary pair of socks 12. The outer surface 22 of the sock bands 10 may contain indicia 24 such as a logo and name of a team or organization. The outer surface 22 of the sock bands 10 may include one or more colors to identify a team or organization. Each sock band 10 of a pair of sock bands may also vary in color from one to the other or come in preprinted fabric. The outer surface 22 of the sock bands 10 may have attached strings of beads or lace.

Figure 2:
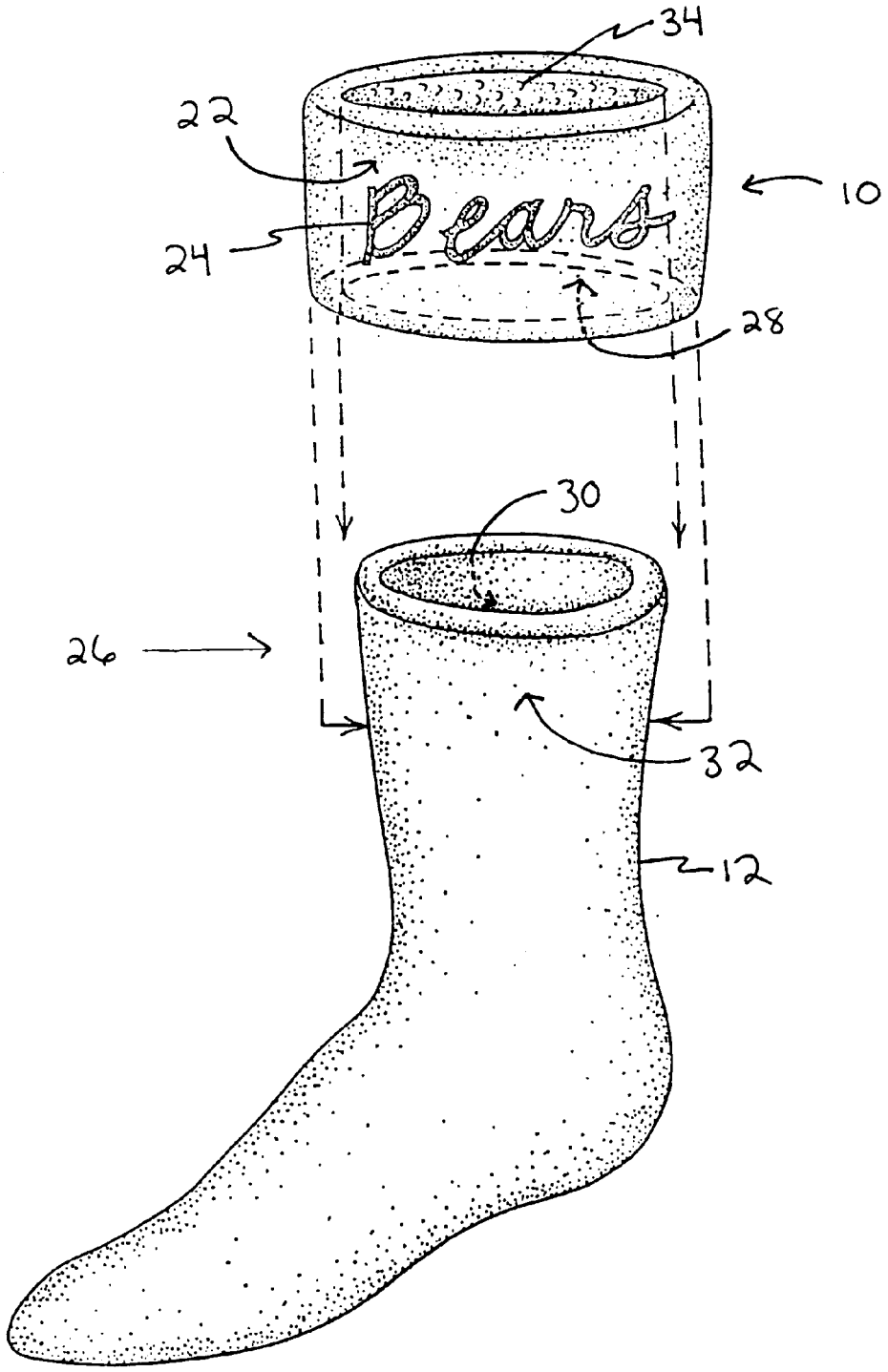
FIG. 2 is a side view of the decorative band being slid onto a sock of the present invention.

FIG. 2 illustrates a sock band 10 being placed onto the top portion 26 of a sock 12. The woven elastic material allows for easily stretching the sock band 10 over the top portion 26 of a sock 12. Each sock band 10 comprises a piece of stretchy material which is folded together and sewn into a tube-like shape. The sock bands 10 include an inner 28 and outer 22 surface.

The top portion 26 of a sock 12 used in combination with the invention 10 includes an inner 30 and outer 32 surface. The tube-like inner surface 28 of the sock bands 10 are dimensioned and configured to slide onto the tube-like top portion 26 of socks 12. Each sock band 10 can be dimensioned and configured to fit the top portion 26 of any sock 12 made for infants, children, and adults.

A fastening means may be utilized to secure each sock band 10 onto the top portion 26 of a sock 12. Such fastening means may include hook and loop fastening material 34, such as Velcro®, or snaps. If Velcro® 34 is utilized to secure the sock band 10 to the top portion 26 of a sock 12, then the inner surface 28 of each sock band 10 would be lined with Velcro® 34. Either the entire inner surface 28 would be lined with Velcro® 34 or just a partial portion of the inner surface 28 would be lined.

If snaps (not shown) are utilized to secure each sock band 10 to the top portion 26 of a sock 12, then a male and female snap which are complementary to one another would be needed. One of the male or female snaps would be attached to the outer surface 32 of the top portion 26 of a sock 12 by a fastening means, while the other complimentary snap would be attached to the inner surface 28 of the sock band 10. If snaps are used to secure each sock band 10 to the top portion 26 a sock 12, then the sock 12 would also be part of the invention 10.

One major benefit of the sock bands 10 is that although fastening means 34 may be used, fastening means 34 are not required in ordinary use because the sock band 10 and the sock 12 may coact to frictionally secure the sock band 10 in place. Also, stretching together the combination of the top portion 26 of the sock 12 and sock band 10 over the legs of the wearer is enough to secure the combination in place.

The outer surface 22 of each sock band 10 bears indicia 24 such as a logo, name, color, preprinted fabric, and/or design to identify a particular team or organization. The present invention 10 starts out as a plain sock band 10 and then a design, color, preprinted fabric, applique, lace, or embroidery is added to make the sock band 10 a functional accessory for many commercial purposes.

Each logo, name, and/or design can be attached in several ways that are common in the art. The preferred method of attaching the above mentioned is by a patch, applique, or embroidering. The design of the applique, embroidery, or logo are not the invention by itself, but the indicia 24 along with the combination of the sock band 10 and sock 12 are the invention.

A problem with most decorative socks is that they have limited uses. They can only be used during a particular season for which the decoration or occasion fits and when the entire sock is worn it must be washed. In the present invention 10, each sock band 10 can be worn many days in a row before being washed. For example, cheerleaders can simply transfer the sock bands 10 to a clean pair of socks 12 for the next game.

Some teams that play sport on the same day against different teams change their team colors. All the cheerleaders would need to do is transfer the sock band 10 with one team colors to the sock bands 10 of another team color. As a result, the sock bands 10 do not limit your sock wear. The sock bands 10 are small in size and therefore easy to store.

It is to be understood that the present invention is not limited to the sole embodiments described above, but encompasses any and all embodiments within the scope of the following claims.

I claim:

1. A sock system comprising:

at least one foot portion adapted for wear on a foot of a user to cover the foot of the user, said foot portion having opposite heel and toe ends;

at least one tubular leg portion having an upper end, said upper end having an outer surface, said tubular leg portion extending from said heel end of said foot portion to form a sock of unitary structure;

an opening in said upper end of said tubular leg portion, said opening adapted for extending a lower leg of a user therethrough such that the upper end of said tubular member extends upward towards a knee of a user;

at least one tubular band, said tubular band being fabricated from woven elastic material folded together to form a tube having a constant diameter, said tubular band having an inner surface and an outer surface;

decorative indicia, said decorative indicia disposed on the outer surface of said tubular band;

means for attaching said outer surface of said top end of the tubular leg portion to said inner surface of said tubular band.

2. The sock system as recited in claim 1, wherein said means for attaching is a hook and loop fastener.

3. The sock system as recited in claim 2, wherein said unitary sock includes a pair of socks and said at least one tubular band includes a pair of bands.

4. The sock system as recited in claim 1, wherein said means for attaching is friction.

* * * * *